United States Patent [19]

Rose

[11] Patent Number: 4,893,785

[45] Date of Patent: Jan. 16, 1990

[54] LIFTING DEVICE

[76] Inventor: Robert E. Rose, Rua Dr. Procópio Ribeiro dos Santos, 187, City of Sao Paulo, State of Sao Paulo, Brazil

[21] Appl. No.: 128,203

[22] Filed: Dec. 3, 1987

[30] Foreign Application Priority Data

Jan. 12, 1987 [BR] Brazil ..... 6700026

[51] Int. Cl.[4] ..... B66F 3/00

[52] U.S. Cl. ..... 254/126

[58] Field of Search ..... 254/122, 126, 9 B, 8 B, 254/10 B, DIG. 4

[56] References Cited

U.S. PATENT DOCUMENTS 2,533,980 12/1950 Weaver ..... 254/9 B 4,093,182 6/1978 Rutenbeck ..... 254/126

FOREIGN PATENT DOCUMENTS 896396 3/1972 Canada ..... 254/126

*Primary Examiner*—Robert C. Watson

*Attorney, Agent, or Firm*—Steinberg & Raskin

[57] ABSTRACT

Lifting device which is a compact, pantographic-type jack with arms forming a pantograph, and driven by a central spindle. Lower arms are suitably linked to a base, with the upper arms suitably linked with respective lower arms. One of the upper arms is longer than the other of the upper arms, with the longer arm being provided with a movable support at a free end thereof, in turn having a device for fitting into or against an object to be lifted, such as an automobile. Furthermore, a support linkage is suitably secured between the movable support and the shorter upper arm.

10 Claims, 1 Drawing Sheet

LIFTING DEVICE

BACKGROUND OF THE INVENTION

The present invention is directed to a new and improved lifting device, namely a compact, pantographic-type jack, in which an object supported thereon remains horizontal or level while being raised or lowered thereby.

Automotive assembly plants have recently been requiring jacks that are provided with certain features, so that the jacks may be stored within the rim of a spare wheel. This calls for a jack to have very small dimensions. In particular, the jack cannot exceed 110 mm in an initial position, while when fully raised, must have a height of no less than 385 mm.

In turn, such a jack must support a car in a lifted position and not slip when the lifting operation is performed on a smooth surface, e.g. on a glazed or neat-surface cement flooring.

Effort to rotate a jack handle must be low, no more than 8 kg, while the jack must be lightweight, no more than 2 to 3 kg, because the greater the deadweight of a vehicle, then the greater the fuel consumption when the latter is being driven.

Known pantographic-type jacks are generally good and secure, but fail to meet one or more of the above-noted requirements.

SUMMARY OF THE INVENTION

Accordingly, it is an object of the present invention to provide a new and improved lifting device, namely a jack for supporting objects, such as automobiles in particular.

It is also an object of the present invention to provide a jack which is extremely compact and lightweight in closed position, but will expand to appropriate height in raised condition.

It is another object of the present invention to provide a new and improved jack or lifting device which will securely support an automobile and not slip when situated on a smooth surface.

It is a further object of the present invention to maintain an object being lifted or lowered substantially level or horizontal, while the same is being lifted or lowered.

These and other objects are provided by the present invention which is directed to a compact, pantographic-type jack, which comprises a lower pair of arms supported on a base, and an upper pair of arms coupled with said lower pair. One of the arms of the upper pair is longer then the other of the arms of the upper pair, with a movable support being provided at a free end of the longer arm. Furthermore, a support linkage is articulated to the shorter arm and coupled to the movable support, so that the movable support remains level while the jack is being raised or lowered. Means for fitting against an object to be supported, such as an automobile, may also be provided upon the movable support, while a spindle for raising and lowering the jack, may also be provided.

Moreover, the arms of the upper pair may be additionally coupled to one another, with the longer arm being coupled to the shorter arm at a point on the shorter arm between coupling of the articulated linkage and coupling of the respective lower arm to the shorter arm.

Accordingly, the compact jack of the present invention fully complies with the following five requirements.

(1) not exceeding 110mm in closed position,
(2) having a height of at least 385mm in raised position,
(3) not slipping on a smooth surface,
(4) weighing not more than 2 to 3 kg, and
(5) not requiring more than 8 kg of effort to rotate a handle of the same.

At the same time, the jack or lifting device of the present invention is simple to construct and also simple to operate.

BRIEF DESCRIPTION OF THE DRAWINGS

The present invention will be described in greater detail with reference to the accompanying drawings, in which.

DESCRIPTION OF THE PREFERRED EMBODIMENTS

Figure 1:
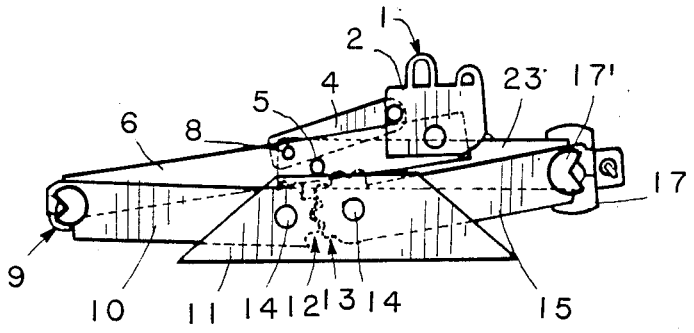
FIG. 1 illustrates a side view of the lifting device or jack in closed position.
Figure 2:
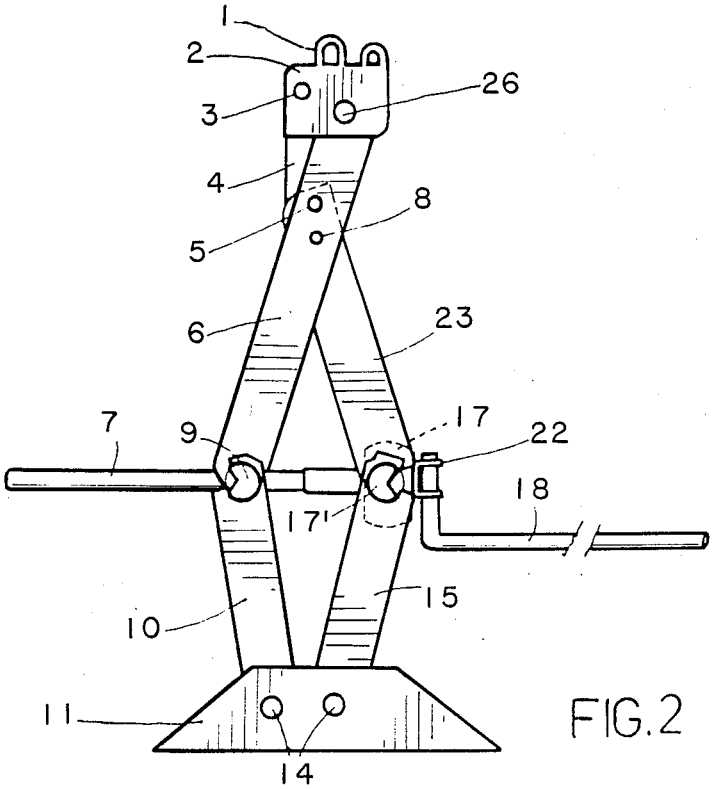
FIG. 2 is a view similar to FIG. 1, but illustrating the lifting device or jack in raised position.

As illustrated in the above figures, the lifting device according to the present invention comprises a foot or base 11 which is a puckered and bent plate, having two holes for riveted shaft means 14 for supporting lower arms 10 and 15 thereon. These lower arms 10 and 15 may be formed from a bent, U-shaped plate or from two individual bars, with or without reinforcing ribs, depending upon the weight to be lifted. At the lower ends of the arms 10 and 15, gears 12 and 13 are secured or stamped thereon, which impart a controlled movement to prevent free displacement of the arms on the riveted shaft means 14, 14.

The upper portion of the jack is provided with two arms 23 and 6, with arm 6 being longer than arm 23, in order to reach the required height that an ordinary pantographic jack, as a result of reduced height, does not reach. Arm construction is the same as in arms 10 and 15.

The lower portions of the two upper arms 23 and 6 are provided with holes that are open by approximately one quarter, i.e. by an arc of about 90° , as illustrated. The two lower arms 10 and 15 are provided, at the upper portions thereof, with two holes that are also opened by approximately one quarter, or an arc of about 90° as also illustrated. The two upper arms and two lower arms are joined together by a nut 9 at one side, and by a bearing box 17 at the other side. Both the nut 9 and the bearing box 17 have small shafts (17') with previously-formed heads, to avoid the use of rivets.

The shaft and shaft heads have a channel that eliminates approximately one quarter of the shaft and head (i.e. about a 90° arc thereof, as illustrated). In other words, each shaft or shaft head comprises a channel cut out of about one quarter of a cross-section thereof, as illustrated. This makes it possible to simply fit the arms 6, 10 into the nut 9 and the arms 23, 15 into the bearing box 17, without jeopardizing the strength of the jack. Instead of the nut 9 and bearing box 17, plates bent into a "U" shape can also be used, having holes in the sides of the U's, and with the arms being joined thereto by four rivets. In this case, the holes in the upper 6, 23 and lower 10, 15 arms must correspond with the diameter of the rivets, without the one quarter openings described above.

It is also possible to combine these two attachment systems as required. Both systems are very well known.

The upper portions of the two upper arms 23 and 6, each contain a hole. Arm 23 has a hole adjoining the upper end thereof as illustrated, while arm 6 has a hole at a lower position as illustrated, with these two arms being joined together at these respective holes by riveted shaft means 8 for joining the same, so that arm 6 extends beyond or above arm 23 as also illustrated. The extent by which arm 6 should extend beyond arm 23, depends upon the required height the jack must reach in the lifted position. At the upper portion of the longer arm 6, a hole is provided, whereby a movable support 2 may be attached by a rivet 26. Above this support, fitting means 1 are provided for fitting against an object to be lifted, e.g. the chassis of an automobile. The fitting means 1 may vary, according to the chassis of the automobile to be lifted.

In order for the support 2 to always remain in a horizontal or level position, regardless of whether the jack is open or closed, a swiveling or articulated support linkage 4 is provided for the support 2, which is attached at one end to the support 2 through a rivet 3. The other end of the linkage 4 is attached at an upper portion of the arm 23 with a rivet 5, which passes through an opening in the upper arm 6 in the case where the arm 6 is formed by a U-shaped bent plate.

The arm assembly is moved upwardly and downwardly by a spindle 7 having a drag crank 22 at one end, with a support for a crank or crank handle 18, as illustrated. This assembly is supported at the other side by the bearing box 17, while the spindle 7 is threaded into the nut 9 (this system is well-known).

An automobile to be lifted for wheel replacement, describes a slight curve relative to the center of the radius between the floor and the tire on the opposite wheel. In order not to strain the jack, the latter should follow this curve. Thus, the jack or lifting device as described above, follows such a curve during the lifting operation.

The preceding description of the present invention is merely exemplary, and is not intended to limit the scope thereof in any way.

What is claimed is:

1. A compact, pantographic-type jack, comprising a lower pair of arms supported on a base, an upper pair of arms coupled with said lower pair, with a respective arm of said upper pair being coupled to a respective arm of said lower pair, one of said arms of said upper pair being longer than the other of said upper pair of arms, a movable support provided at a free end of said longer arm, and a support linkage articulated to said shorter arm and coupled to said movable support, wherein said arms of said upper pair are additionally coupled to one another, and said arms of said lower pair remain uncoupled from one another, and said longer arm is coupled to said shorter arm at a point on said shorter arm between coupling of said articulated linkage and coupling of said respective lower arm to said shorter arm, whereby said movable support remains level while said jack is being raised or lowered.

2. The combination of claim 1, additionally comprising means provided upon said movable support, for fitting against an object to be supported.

3. The combination of claim 1, additionally comprising a spindle for raising and lowering said jack.

4. The combination of claim 1, additionally comprising a pair of gears, each said gear situated at a lower end of one of said lower pair of arms, and positioned to mesh with the gear of the opposite lower arm, whereby movement of said arms is controlled during the raising or lowering of said jack.

5. The combination of claim 1, additionally comprising nut means for coupling one of said upper pair of arms with one of said lower pair of arms, and bearing box means for coupling the other of said upper pair of arms with the other of said lower pair of arms.

6. The combination of claim 5, wherein upper ends of said lower pair of arms each comprise a hole therethrough, which is open along a circumference thereof by about a 90° arc, lower ends of said upper pair of arms each comprise a hole therethrough which is open along a circumference thereof by about a 90° arc, with said nut means and bearing box means coupling said respective arms through said respective holes.

7. The combination of claim 6, wherein said nut means and said bearing box means each comprise a shaft for coupling said respective arms, each said shaft comprising a channel cut out of about one-quarter of a cross-section thereof.

8. The combination of claim 3, additionally comprising a drag crank positioned at one end of said spindle, and a crank handle supported on said drag crank.

9. The combination of claim 5, wherein said longer arm of said upper pair si coupled through said nut means to said respective arm of said lower pair, and said shorter arm of said upper pair is coupled through said bearing box means to said respective arm of said lower pair.

10. The combination of claim 1, wherein said longer arm is coupled to a bottom portion of said support.

* * * * *